US011485598B2

(12) United States Patent
Morimoto

(10) Patent No.: US 11,485,598 B2
(45) Date of Patent: Nov. 1, 2022

(54) CONVEYANCE APPARATUS, METHOD, AND STORAGE MEDIUM

(71) Applicant: CANON KABUSHIKI KAISHA, Tokyo (JP)

(72) Inventor: Yasushi Morimoto, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/180,477

(22) Filed: Feb. 19, 2021

(65) Prior Publication Data

US 2021/0276819 A1 Sep. 9, 2021

(30) Foreign Application Priority Data

Mar. 3, 2020 (JP) ..... JP2020-036035

(51) Int. Cl.

| | |
|---|---|
| ***B41J 11/00*** | (2006.01) |
| ***B65H 26/00*** | (2006.01) |
| ***B41J 15/18*** | (2006.01) |
| *B65H 16/00* | (2006.01) |

(52) U.S. Cl.

CPC ..... *B65H 26/00* (2013.01); *B41J 11/003* (2013.01); *B41J 15/18* (2013.01); *B65H 16/00* (2013.01); *B65H 2511/12* (2013.01); *B65H 2801/03* (2013.01); *B65H 2801/06* (2013.01)

(58) Field of Classification Search

CPC ..... B65H 26/00; B65H 2511/12; B65H 2801/06; B65H 2801/03; B65H 16/00; B41J 11/003; B41J 15/18

See application file for complete search history.

(56) References Cited

U.S. PATENT DOCUMENTS

2006/0279624 A1* 12/2006 Tsuchiya ..... B41J 11/46 347/218

FOREIGN PATENT DOCUMENTS

JP 2007225816 A 9/2007
JP 2012091932 A * 5/2012 ..... B65H 7/02

* cited by examiner

*Primary Examiner* — Yaovi M Ameh

(74) *Attorney, Agent, or Firm* — Canon U.S.A., Inc. I.P. Division

(57) ABSTRACT

A conveyance apparatus includes a conveyance unit, a first storage unit, a second storage unit, a measurement unit, and a determination unit. The conveyance unit conveys paper. The first storage unit stores a width of standard paper. The width of the standard paper is a length in a direction crossing a conveyance direction of the paper conveyed by the conveyance unit. The second storage unit stores a user-registered paper width which is different from the width of the standard paper. The user-registered paper width is input by a user. The measurement unit measures a width of the paper. The determination unit determines, based on the measured width and the paper widths stored in the first storage unit and the second storage unit, a width to serve as the measured width.

16 Claims, 9 Drawing Sheets

100
RECORDING APPARATUS
150
PRINTER ENGINE
151
INKJET HEAD
152
CUTTER UNIT
153
CONVEYANCE MOTOR
154
I/F
155
OPTICAL SENSOR
156
120
PRINTER CONTROLLER
121
HDD I/F
122
INPUT/ OUTPUT DEVICE I/F
123
FLASH ROM
124
RAM
125
ROM I/F
126
MEMORY CONTROLLER
127
HOST I/F
128
CPU
129
CONTROLLER ENGINE I/F
130
IMAGE PROCESSING UNIT
132
161
HDD
162
INPUT/ OUTPUT DEVICE
190
HOST COMPUTER
191

FIG.5A

| | LOWER LIMIT VALUE | REGISTERED WIDTH | UPPER LIMIT VALUE |
|---|---|---|---|
| REGISTRATION NUMBER 1 | 199.5 | 200.0 | 200.5 |
| REGISTRATION NUMBER 2 | — | — | — |
| REGISTRATION NUMBER 3 | 641.2 | 654.3 | 667.4 |

FIG.5B

| NO. | NAME OF STANDARD ROLL PAPER | WIDTH |
|---|---|---|
| 1 | ISO A3/A4 ROLL | 297.0 |
| 2 | 300-mm ROLL | 300.0 |
| 3 | 12-INCH ROLL | 304.8 |
| 4 | A3+ ROLL | 329.0 |
| 5 | 14-INCH ROLL | 355.6 |
| 6 | 15-INCH ROLL | 381.0 |
| 7 | 16-INCH ROLL | 406.4 |
| 8 | ISO A2/A3 ROLL | 420.0 |
| 9 | 17-INCH ROLL | 431.8 |
| 10 | 18-INCH ROLL | 457.2 |
| 11 | 500-mm ROLL | 500.0 |
| 12 | 20-INCH ROLL | 508.0 |
| 13 | JIS B2/B3 ROLL | 515.0 |
| 14 | 22-INCH ROLL | 558.8 |
| 15 | ISO A1/A2 ROLL | 594.0 |
| 16 | 600-mm ROLL | 600.0 |
| 17 | 24-INCH ROLL | 609.6 |

FIG.5C

| NO. | PAPER SIZE A | PAPER SIZE B | PRIORITY SETTING |
|---|---|---|---|
| 1 | ISO A3/A4 ROLL | 300-mm ROLL | A |
| 2 | 300-mm ROLL | 12-INCH ROLL | B |
| 3 | 500-mm ROLL | 20-INCH ROLL | B |
| 4 | 20-INCH ROLL | JIS B2 ROLL | A |
| 5 | ISO A1/A2 ROLL | 600-mm ROLL | A |
| 6 | 600 mm | 24-INCH ROLL | B |
| ⋮ | ⋮ | ⋮ | ⋮ |

CONVEYANCE APPARATUS, METHOD, AND STORAGE MEDIUM

BACKGROUND

Field

The present disclosure relates to a conveyance apparatus, a method, and a storage medium.

Description of the Related Art

Japanese Patent Application Laid-Open No. 2007-225816 discusses a method by which a user sets the width of non-standard size paper so that the user can use a function with not only standard size paper but also non-standard size paper. In this method, the user can set the size of paper loaded in a paper feed stage by selecting the paper size from among paper size settings.

According to the method discussed in Japanese Patent Application Laid-Open No. 2007-225816, what size of paper is loaded is set again each time a different size of paper is loaded. This is troublesome for the user.

SUMMARY

According to an aspect of the present disclosure, a conveyance apparatus includes a conveyance unit configured to convey paper, a first storage unit configured to store a width of standard paper, wherein the width of the standard paper is a length in a direction crossing a conveyance direction of the paper conveyed by the conveyance unit, a second storage unit configured to store a user-registered paper width which is different from the width of the standard paper, wherein the user-registered paper width is input by a user, a measurement unit configured to measure a width of the paper, and a determination unit configured to determine, based on the measured width and the paper widths stored in the first storage unit and the second storage unit, a width to serve as the measured width.

Further features of the present disclosure will become apparent from the following description of exemplary embodiments with reference to the attached drawings.

BRIEF DESCRIPTION OF THE DRAWINGS

FIGS. 5A to 5C are tables illustrating information about paper widths stored in a flash read-only memory (ROM) according to the exemplary embodiment.

DESCRIPTION OF THE EMBODIMENTS

An exemplary embodiment of the present disclosure is directed to reducing the user's time and effort to set a paper size.

The exemplary embodiment will be described in detail below with reference to the attached drawings.

[Apparatus Configuration]

Figure 1:
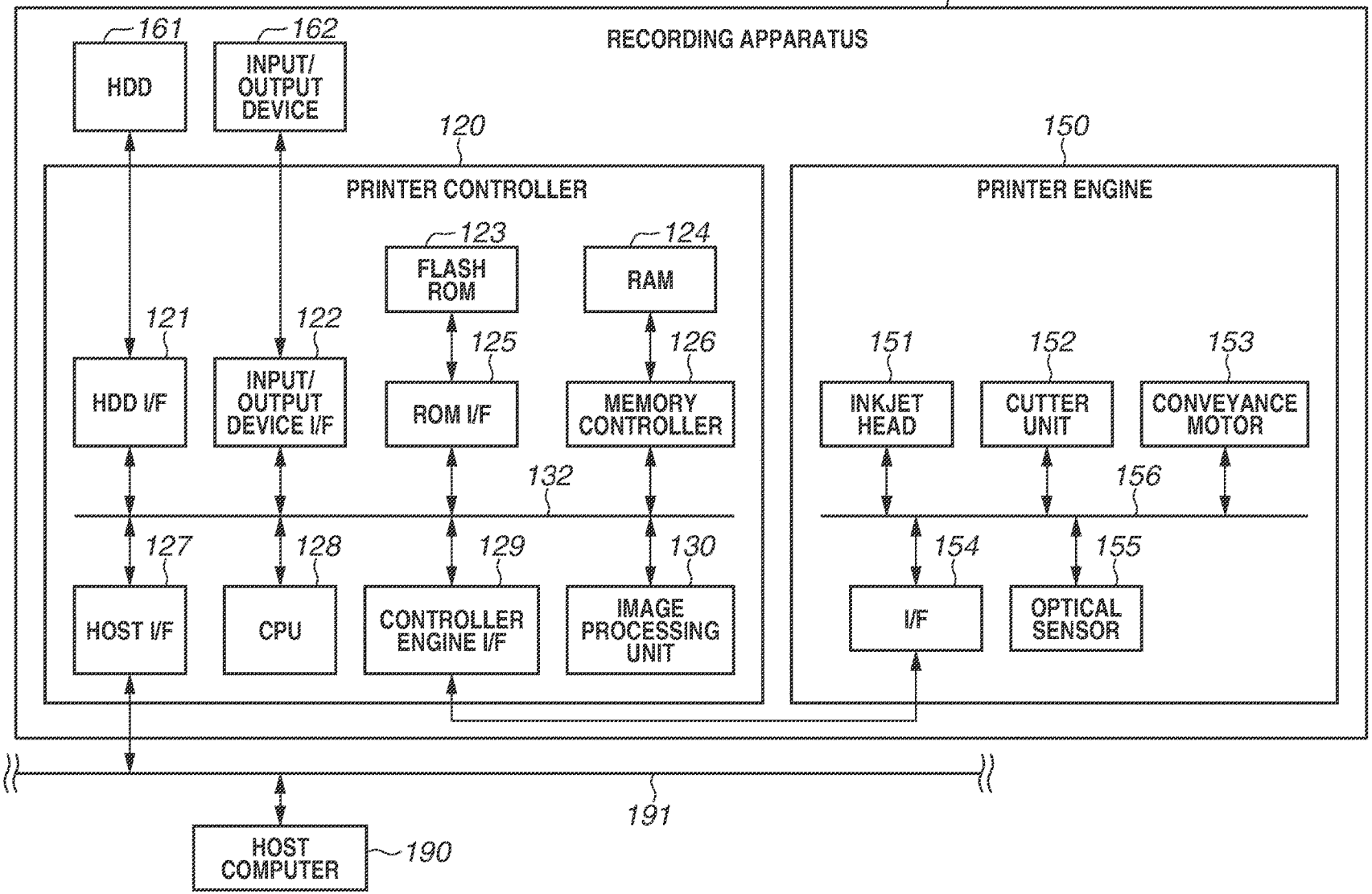
FIG. 1 is a diagram illustrating a schematic configuration of a recording apparatus according to an exemplary embodiment.

FIG. 1 is a diagram illustrating a schematic configuration of a recording apparatus 100 including an image processing apparatus according to the present exemplary embodiment. While in the present exemplary embodiment, the recording apparatus 100 including the image processing apparatus and a printing function is described below as an example, the application example of the image processing apparatus is not limited thereto. For example, the image processing apparatus may be configured as an apparatus that includes a reading device for reading an image on a document and serves as a copying machine, or configured as a multifunction peripheral (MFP) having other functions. The image processing apparatus may be applied to a paper feed apparatus that feeds paper.

In FIG. 1, the recording apparatus 100 includes a printer controller 120, a printer engine 150, a hard disk drive (HDD) 161, and an input/output device 162. The recording apparatus 100 can connect to a host computer 190 via a network 191. The printer controller 120 includes an HDD interface (I/F) 121, an input/output device I/F 122, a read-only memory (ROM) I/F 125, and a memory controller 126. The printer controller 120 also includes a host I/F 127, a central processing unit (CPU) 128, a controller engine I/F 129, and an image processing unit 130. These components are connected via a system bus 132. The printer controller 120 further includes a flash ROM 123 and a random access memory (RAM) 124 that are connected to the system bus 132 via the ROM I/F 125 and the memory controller 126, respectively. The printer controller 120 implements the functions of the image processing apparatus by using the hardware components included therein. The CPU 128 is in the form of a microprocessor (microcomputer) and controls operation of the entire recording apparatus 100 by executing programs and activating the hardware components. The flash ROM 123 stores programs to be executed by the CPU 128 and various types of data to be used in various operations of the recording apparatus 100. The RAM 124 is used as a work area of the CPU 128 and a temporary storage area for various types of received data, and stores various types of set data.

The image processing unit 130 performs various types of image processing. For example, the image processing unit 130 performs processing for rasterizing (converting) print data to be used by the recording apparatus 100 (e.g., data written in a page description language) into image data (bitmap image data), and other image processing. The image processing unit 130 also converts the color space (such as a YCbCr color space) of image data included in the input print data into a typical red-green-blue (RGB) color space (such as an sRGB color space). The image processing unit 130 also applies various types of image processing to image data as appropriate. Examples of the image processing include resolution conversion into an effective number of pixels (printable by the recording apparatus 100), image analysis, and image correction. The image data obtained by such image processing is stored in the RAM 124 or the HDD 161.

The printer engine 150 is a printing unit that performs image formation. The printer engine 150 includes an inkjet head 151, a cutter unit 152, a conveyance motor 153, an interface 154 with the printer controller 120, and an optical sensor 155. These components are connected via a system bus 156.

The inkjet head 151 is a printing unit that prints an image. The inkjet head 151 prints an image on a sheet based on image data. For example, the inkjet head 151 includes nozzle arrays for a plurality of colors, and forms an image on a sheet by discharging ink from the nozzle arrays in synchronization with conveyance of the sheet in a conveyance direction (+Y direction) indicated by the arrow in FIG. 2. While an inkjet printer using ink as a recording material is described as an example of the recording apparatus 100 according to the present exemplary embodiment, the recording apparatus 100 is not limited thereto. The exemplary embodiment of the present disclosure is applicable to recording apparatuses using various printing methods, including thermal printers (such as a sublimation printer and a thermal transfer printer), dot impact printers, light-emitting diode (LED) printers, and electrophotographic printers such as a laser printer.

The cutter unit 152 is a mechanism for cutting of roll paper 204 (see FIG. 2) that is used as a recording medium for printing in the present exemplary embodiment. The recording medium will hereinafter be referred to as "paper". However, in the present exemplary embodiment, cloth and an overhead projector (OHP) sheet can be used as the recording medium aside from paper. A medium not intended for recording may also be used. The cutter unit 152 cuts the roll paper 204 with an image printed thereon into a predetermined length. In the case of a type of paper on which paper dust scatters when the paper is cut with the cutter unit 152, a setting to form a cutting dust reduction line at a predetermined cut position is stored in the flash ROM 123 to prevent the scattering of paper dust during cutting. In addition, for each paper type, an operation setting of the cutter unit 152 can be stored in the flash ROM 123 independently of the cutting dust reduction line setting. In the case of a type of paper that is unable to be cut with the cutter unit 152, a setting not to operate the cutter unit 152 so that the user can cut the paper with scissors (i.e., user cut setting) is stored in the flash ROM 123. In the case of a type of paper that requires the user to hold the paper because otherwise a cut line can curve, a setting to operate the cutter unit 152 by the user's operation (i.e., eject cut setting) is stored in the flash ROM 123. In the case of a paper type not subjected to the user cut setting or the eject cut setting, a setting to automatically cut the paper with the cutter unit 152 (i.e., automatic cut setting) is stored in the flash ROM 123.

The conveyance motor 153 drives conveyance rollers 205 (see FIG. 2) for conveying the roll paper 204, and is controlled by the CPU 128. The optical sensor 155 is a measurement unit for detecting the width (length in an X direction) of the recording medium. The optical sensor 155 is a reflective optical sensor including an LED serving as a light emitting element, a regular reflection light receiving element, and a diffused light receiving element.

The input/output device 162 includes an input unit for the user to perform various operations to input information, and a display unit (output unit) for notifying the user of various types of information. The input unit includes hardware keys, a panel, and/or a microphone capable of voice input. The output unit may notify the user of information by outputting a sound (such as a buzzer or a voice) based on audio information from a sound generator. At the time of paper feeding, the user selects a paper type and instructs the recording apparatus 100 to feed the selected paper type by using the input/output device 162. The recording apparatus 100 performs conveyance set for each paper type.

The HDD 161 is a nonvolatile storage area. Programs to be executed by the CPU 128, print data, and setting information to be used in various operations of the recording apparatus 100 can be stored in and read from the HDD 161. Other large-capacity storage devices such as a flash memory may be used instead of the HDD 161.

In the present exemplary embodiment, the input/output device 162 is described as being included in the recording apparatus 100. However, the configuration is not limited thereto. For example, the input/output device 162 may be connected to the recording apparatus 100 via the network 191 as an external component. Alternatively, the host computer 190 and a display connected to the host computer 190 may serve as the input/output device 162. The recording apparatus 100 may further be connectable with other input/output devices via the network 191 aside from the input/output device 162.

The host computer 190 is an external device serving as a source of print data, for example. A printer driver for controlling the recording apparatus 100 is installed on the host computer 190. A data provision device serving as a source of print data may be provided for the recording apparatus 100 instead of the host computer 190. Examples of the data provision device include an image reader, a digital camera, and a smartphone. The connection between such devices and the recording apparatus 100 is not limited to the connection via the network 191. For example, the devices and the recording apparatus 100 may be directly connected by wireless communication.

Figure 2:
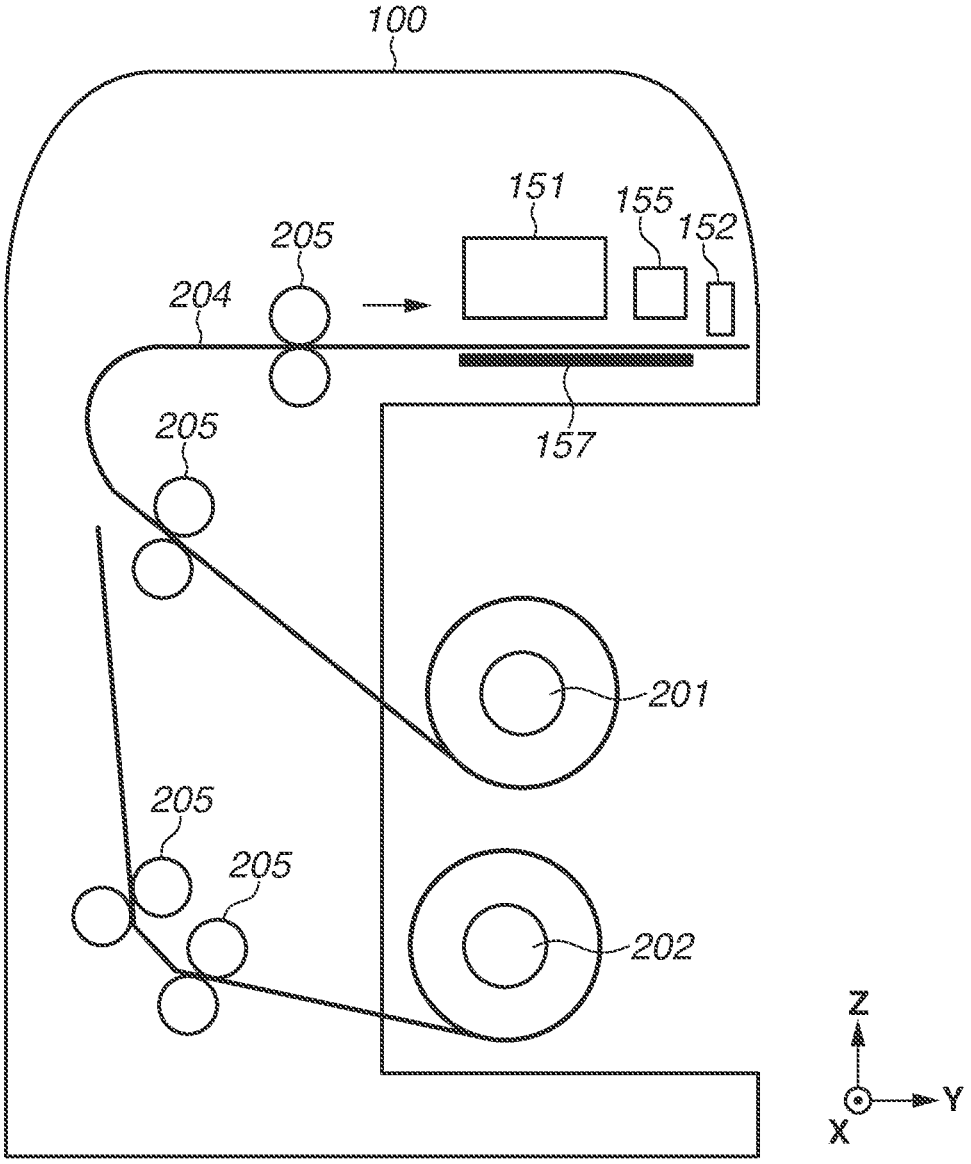
FIG. 2 is a schematic sectional view of the recording apparatus according to the exemplary embodiment.

FIG. 2 is a schematic sectional view of the recording apparatus 100 according to the present exemplary embodiment. The recording apparatus 100 according to the present exemplary embodiment includes two roll paper tubes, i.e., upper and lower roll paper tubes 201 and 202 where respective different types and widths of roll paper can be installed. FIG. 2 illustrates a state where the roll paper 204 is conveyed from the upper roll paper tube 201 by the conveyance rollers 205 along a conveyance path, and reaches a position where the roll paper 204 is measured by the optical sensor 155 located opposite to a platen 157. When the roll paper 204 is conveyed as the recording medium to the position illustrated in FIG. 2, the optical sensor 155 scans in the X direction to measure the width of the roll paper 204, which is the length of the roll paper 204 in the direction crossing the conveyance direction, i.e., the length of the roll paper 204 in the X direction. The image processing unit 130 generates image data from print data based on the measured width. The roll paper 204 is conveyed back in the −Y direction to a recording position on the platen 157. The inkjet head 151 prints an image by discharging ink onto the roll paper 204 based on the image data. After the end of the printing, the cutter unit 152 cuts the roll paper 204. To switch the roll paper tube to be used from the upper roll paper tube 201 to the lower roll paper tube 202, the roll paper 204 is first returned to the upper roll paper tube 201 by the conveyance rollers 205. Roll paper is then fed from the lower roll paper tube 202 by the conveyance rollers 205, whereby the roll paper can be switchingly fed.

The configuration illustrated in FIG. 2 is just an example, and the number of loadable pieces of roll paper, the positional relationship between the upper and lower roll paper tubes 201 and 202 and the inkjet head 151, and the layout position of the optical sensor 155 can be set as appropriate. For example, the optical sensor 155 may be located at a position where the widths of the roll paper loaded in the upper and lower roll paper tubes 201 and 202 can be measured, and may measure the widths of the roll paper in the state of being loaded in the upper and lower roll paper tubes 201 and 202. While the recording apparatus 100 according to the present exemplary embodiment is described as being configured to use roll paper, the recording apparatus 100 according to the present exemplary embodiment may be applied to a recording apparatus using cut sheets.

[Registration/Deletion Processing]

In the present exemplary embodiment, the width of the roll paper 204 is determined based on a value measured by the optical sensor 155 when the roll paper 204 is fed onto the platen 157. In the present exemplary embodiment, as illustrated in FIG. 4G, the width of the roll paper 204 is the length of the roll paper 204 in the X direction.

The flash ROM 123 stores a standard size table that includes standard size paper that is commonly and widely available. In the present exemplary embodiment, a size table that includes paper sizes mostly used among available standard sizes is stored in the flash ROM 123 in advance. The paper sizes stored in advance will hereinafter be referred to as standard sizes. Whether the width of the roll paper 204 is one of the widths of the standard sizes stored in the flash ROM 123 can thus be determined based on the measured value of the optical sensor 155.

If paper has a size other than the standard sizes stored in the flash ROM 123, the width measured by the optical sensor 155 is not determined as that of a standard size. If the user sets the width of paper when the paper is determined to be non-standard size paper, the user needs to set the width each time non-standard size paper is loaded, which is troublesome for the user.

In addition, if the width measured by the optical sensor 155 is used for printing, the same image can be printed in different image sizes. Such a phenomenon can occur in the case of using a printing method where the print size of an image is determined depending on the paper width. Among such printing methods, there is borderless printing where an image having a width slightly greater than the paper width is recorded to leave no margin. If borderless printing is performed by measuring the paper width each time and printing an image based on the measured width, the same image data can be printed in different image sizes because the measured values of the paper having the same width vary slightly due to measurement errors.

In the present exemplary embodiment, the width of non-standard size paper can be stored in the flash ROM 123 as a user-registered paper width. By registering the width of the non-standard size paper the user wishes to use, the user can save the time and effort to set the width when using the non-standard size paper. In addition, images of the same size can be obtained even with paper having a non-standard size width.

Figure 3:
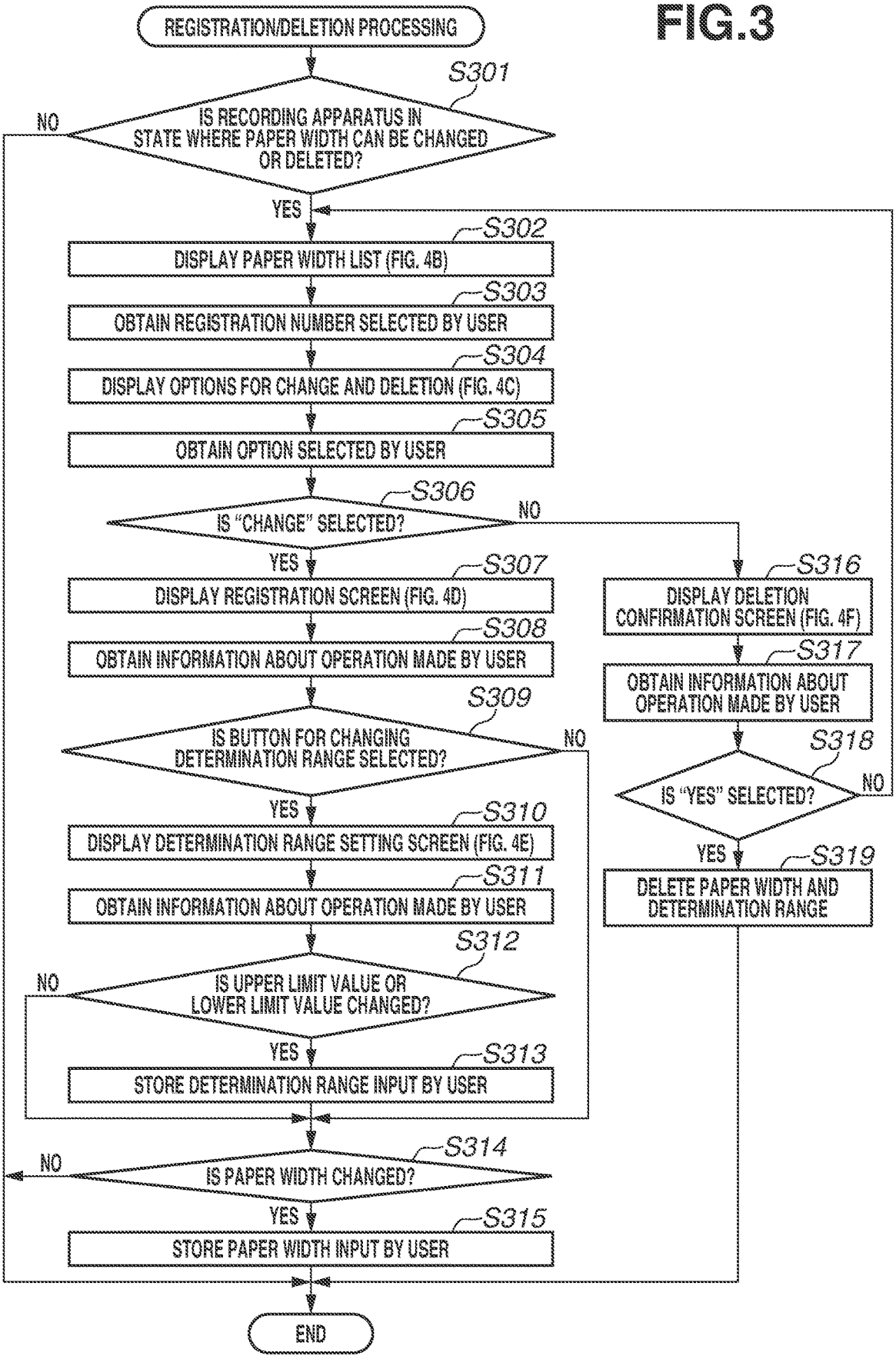
FIG. 3 is a flowchart of registration and deletion processing for a non-standard size paper width according to the exemplary embodiment.

FIG. 3 is a flowchart of processing performed when the user registers the width of non-standard size paper as the user-registered paper width in the recording apparatus 100, and when the user deletes the user-registered paper width. FIGS. 4A to 4F are diagrams illustrating examples of screens displayed on the input/output device 162 during the processing of FIG. 3. The processing of FIG. 3 is implemented, for example, by the CPU 128 illustrated in FIG. 1 loading a program stored in the flash ROM 123 into the RAM 124 and performing processing based on the program. The processing of FIG. 3 may be performed by software on the host computer 190.

Figure 4A:
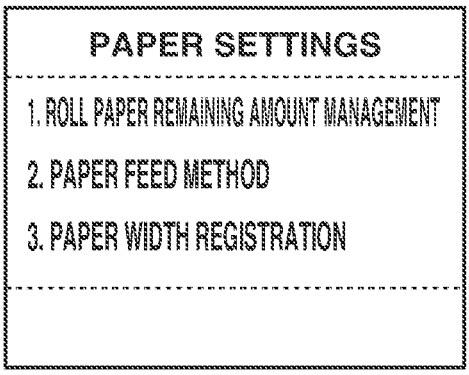
FIGS. 4A to 4F are diagrams illustrating examples of screens displayed on an input/output device according to the exemplary embodiment.

The processing of the flowchart of FIG. 3 is started when the user selects an item "paper width registration" on the paper settings screen of the input/output device 162 illustrated in FIG. 4A.

In step S301, the CPU 128 determines whether the recording apparatus 100 is in a state where a registered paper width can be changed or deleted. The state where a registered paper width can be changed or deleted refers to a state where paper, i.e., the roll paper 204 is not moving in the recording apparatus 100 (a state where paper feeding or printing is not performed). If the recording apparatus 100 is determined to be in the state where a registered paper width can be changed or deleted (YES in step S301), the processing proceeds to step S302. If the recording apparatus 100 is determined to be in a state where a registered paper width is unable to be changed or deleted (NO in step S301), the CPU 128 displays, on the input/output device 162, a message indicating that registration is not currently available, and the processing ends.

Figure 4B:
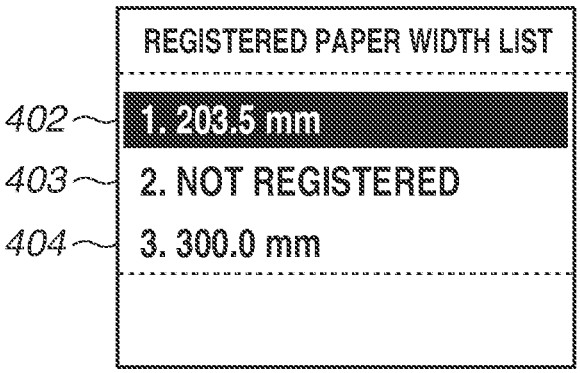

A width of standard paper may be listed in standard paper sizes set out in ANSI/ASME Y14.1 and ISO 216, such as 8.5×11 inches (letter) and 210×297 mm (A4). In step S302, the CPU 128 displays, on the input/output device 162, a list of current user-registered paper widths (illustrated in FIG. 4B). In the present exemplary embodiment, up to three non-standard paper widths can be registered. In FIG. 4B, a top 402 of the list indicates that a paper width of 203.5 mm is registered with registration number "1", and a bottom 404 of the list indicates that a paper width of 300.0 mm is registered with registration number "3". A middle 403 of the list indicates that no paper width is registered with registration number "2". While the maximum number of registrable paper widths is three in the present exemplary embodiment, the maximum number is not limited thereto.

In step S303, the CPU 128 obtains the registration number selected by the user from the list of FIG. 4B.

Figure 4C:
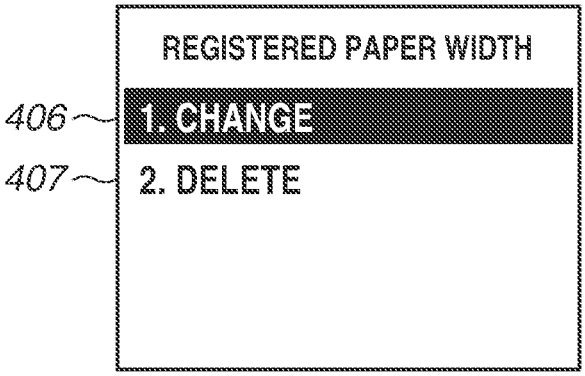

In step S304, the CPU 128 displays an option 406 for change and an option 407 for deletion on the input/output device 162 as illustrated in FIG. 4C.

In step S305, the CPU 128 obtains the option selected by the user on the screen of FIG. 4C.

In step S306, if the option 406 ("change") is determined to be selected by the user (YES in step S306), the processing proceeds to step S307. If the option 406 ("change") is determined not to be selected (NO in step S306), the processing proceeds to step S316.

Figure 4D:
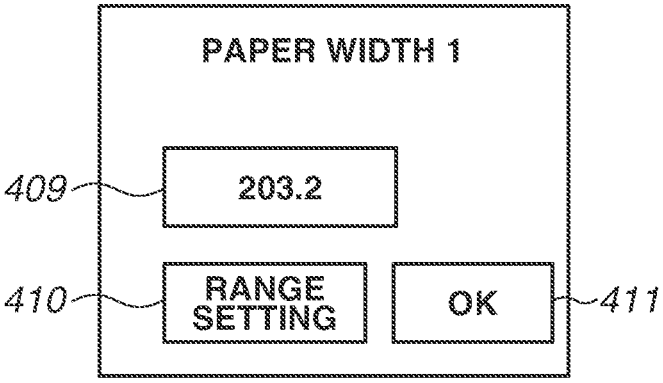

In step S307, the CPU 128 displays a registration screen illustrated in FIG. 4D on the input/output device 162. The registration screen displays a button 409 that displays a currently-set paper width, and a range setting button 410 for setting a paper width range. If registration number "2" with which "not registered" is displayed in FIG. 4B is selected, the last value measured by the optical sensor 155 is displayed on the button 409 illustrated in FIG. 4D. Alternatively, the button 409 may be displayed without a value. On the registration screen of FIG. 4D, the button 409 displays the paper width to be registered. The range setting button 410 is used to set a determination range which is the paper width range to be determined as the paper width to be registered this time. The user can press an "OK" button 411 to confirm the change. If the "OK" button 411 is pressed, the screen display returns to the screen of FIG. 4B. The user makes an operation for selecting any one of the buttons 409, 410, and 411 on the registration screen.

If the user makes the operation, then in step S308, the CPU 128 obtains information about the operation made by the user on the registration screen.

In step S309, the CPU 128 determines whether the button 410 for changing the determination range is selected by the user based on the information obtained in step S308. If the button 410 is determined to be selected (YES in step S309), the processing proceeds to step S310. If the CPU 128 determines that the button 409 illustrated in FIG. 4D is selected and a value is input and set as the user-registered paper width (NO in step S309), the processing proceeds to step S314.

Figure 4E:
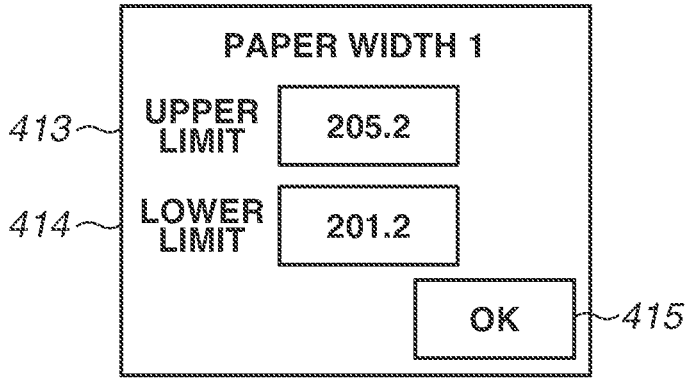

In step S310, the CPU 128 displays a determination range setting screen illustrated in FIG. 4E on the input/output device 162. The determination range setting screen is used to input an upper limit value and a lower limit value of the determination range to be determined as the registered paper width (user-registered paper width). The user can input an upper limit value in a section 413 and a lower limit value in a section 414 on this screen. If an "OK" button 415 is selected, the setting is completed.

In step S311, the CPU 128 obtains information about the operation made by the user on the determination range setting screen of FIG. 4E.

In step S312, if the upper limit value or the lower limit value is determined to be changed by the user based on the information obtained in step S311 (YES in step S312), the processing proceeds to step S313. If neither of the upper and lower limit values is determined to be changed (NO in step S312), the processing proceeds to step S314.

In step S313, the CPU 128 stores, in the flash ROM 123, the values of the determination range input by the user on the determination range setting screen of FIG. 4E. After the values are stored, the processing proceeds to step S314.

In step S314, if the paper width to be registered is determined to be changed by the user on the registration screen of FIG. 4D (YES in step S314), the processing proceeds to step S315. If the paper width to be registered is determined not to be changed (NO in step S314), the processing ends.

In step S315, the CPU 128 stores, in the flash ROM 123, the value of the paper width input by the user. Then the processing ends.

On the other hand, if the option 407 ("delete") is selected on the screen of FIG. 4C, the CPU 128 determines that the option 406 ("change") is not selected in step S306 (NO in step S306), and the processing proceeds to step S316. In step S316, the CPU 128 display a deletion confirmation screen of FIG. 4F on the input/output device 162 to prompt the user to confirm whether to delete the selected user-registered paper width. More specifically, the deletion confirmation screen of FIG. 4F prompts the user to confirm whether to delete the information about the paper width corresponding to registration number "1". The user selects a "YES" button 416 or a "NO" button 417 on the deletion confirmation screen.

Figure 4F:
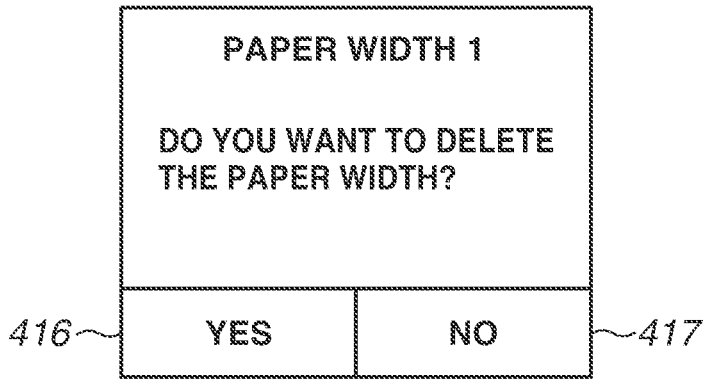
Figure 4G:
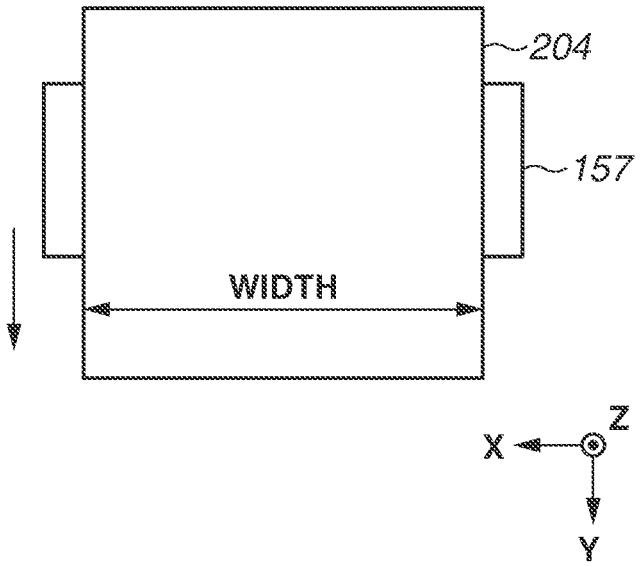
FIG. 4G illustrates a roll paper width.

In step S317, the CPU 128 obtains information about the operation made by the user on the deletion confirmation screen of FIG. 4F.

In step S318, if the "YES" button 416 is determined to be selected by the user on the deletion confirmation screen of FIG. 4F based on the information obtained in step S317 (YES in step S318), the processing proceeds to step S319. If the "NO" button 417 is selected, the CPU 128 determines that the "YES" button 416 is not selected (NO in step S318), and the processing proceeds to step S302.

In step S319, the CPU 128 deletes, from the flash ROM 123, the paper width and the determination range that correspond to the registration number obtained in step S303. Then the processing ends.

[Paper Width Storage Format]

FIGS. 5A to 5C are tables illustrating information about paper widths stored in the flash ROM 123. The tables are used in paper width determination processing.

FIG. 5A illustrates data on registered paper widths stored by the user in the registration processing. Each of three registered paper widths includes data on a registered width and the upper and lower limit values of the determination range which is the paper width range to be determined as the registered width. Registration numbers in FIG. 5A correspond to the numbers in the registered paper width list of FIG. 4B. If the user does not set an upper limit value or a lower limit value in the registration processing, a tolerance of ±1% of the registered width is stored as predetermined upper and lower limit values. If the user sets an upper limit value and a lower limit value in step S311, the upper and lower limit values set by the user are stored.

FIG. 5B illustrates a data storage format of standard size paper widths. The names of roll paper of standard sizes and the widths corresponding to the respective names are stored in the table. The determination range of each of the standard sizes corresponds to a tolerance of ±1% of the width indicated in FIG. 5B. If the measured value of the optical sensor 155 falls within any of the determination ranges, the paper is regarded as standard size paper. FIG. 5C illustrates stored data on the priority settings of standard size paper. If paper falling within a tolerance of ±1% of a width indicated in FIG. 5B is determined as standard size paper having that determination range, the measured width of the paper may fall within a plurality of determination ranges because the determination ranges of some of the standard sizes overlap. For example, "300-mm roll" has a determination range of 297 to 303 mm and "12-inch roll" has a determination range of 301.8 to 307.8 mm, i.e., the determination ranges overlap. A priority as to which of the standard sizes is preferentially set in such a case can be set in advance. The table of FIG. 5C includes such priority settings. The determination ranges overlap between paper in the "paper size A" column and paper in the "paper size B" column at the same row, and which to give priority to, paper size A or paper size B, is set in the "priority setting" column. For example, the priority setting between "300-mm roll" in the "paper size A" column and "12-inch roll" in the "paper size B" column is "B". Thus, if the measured value falls within the overlap between the two determination ranges, "12-inch roll" is given priority. While the priority settings of FIG. 5C are made in advance, the priority settings may be changeable by the user.

In the present exemplary embodiment, the data on the standard size paper widths and the data on the user-registered paper widths are stored in the same flash ROM 123. Alternatively, the two types of data may be stored in different memories.

[Paper Width Determination Processing]

Figure 6:
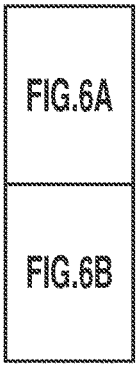
FIG. 6, consisting of 6A and 6B, is a flowchart of paper width determination processing according to the exemplary embodiment.
Figure 6A:
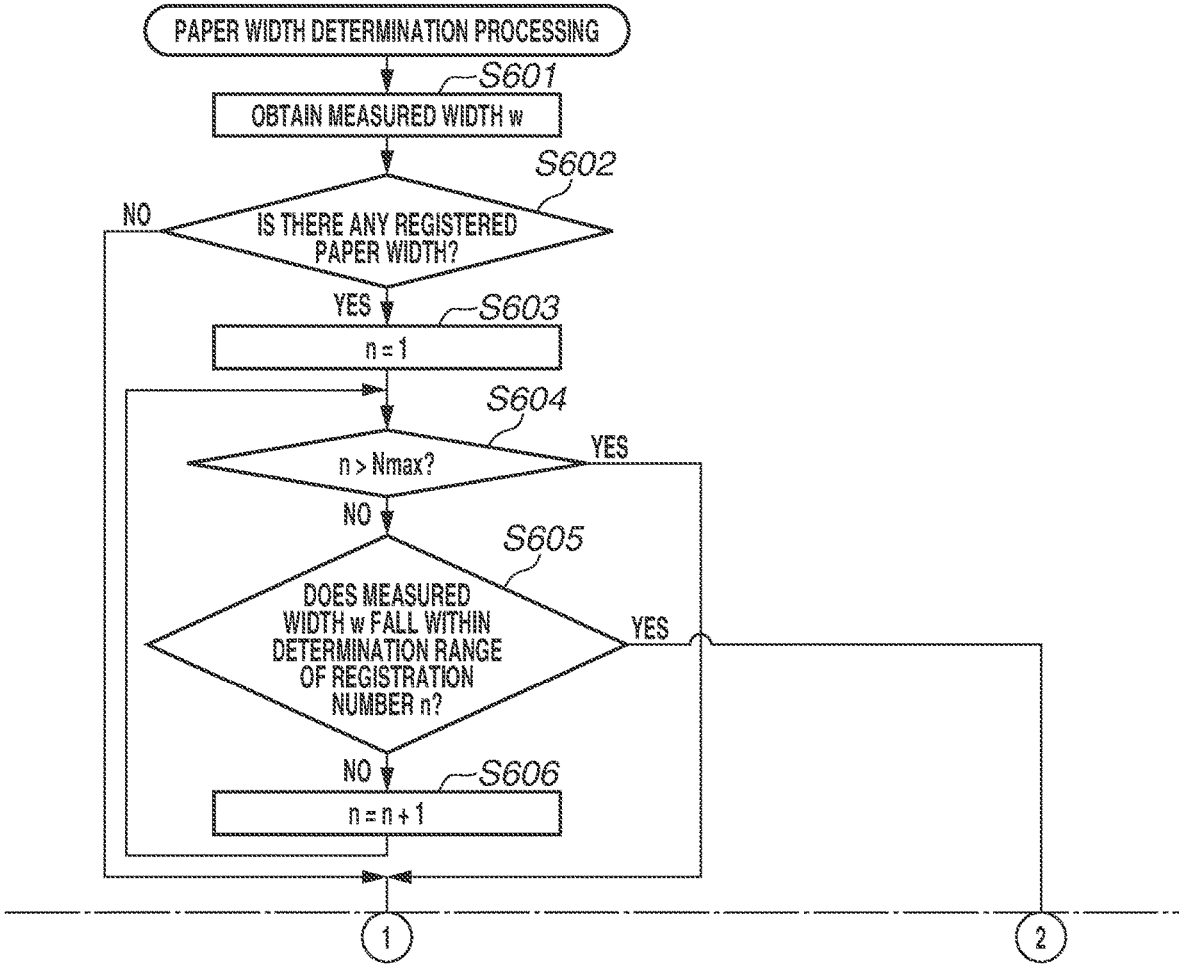
Figure 6B:
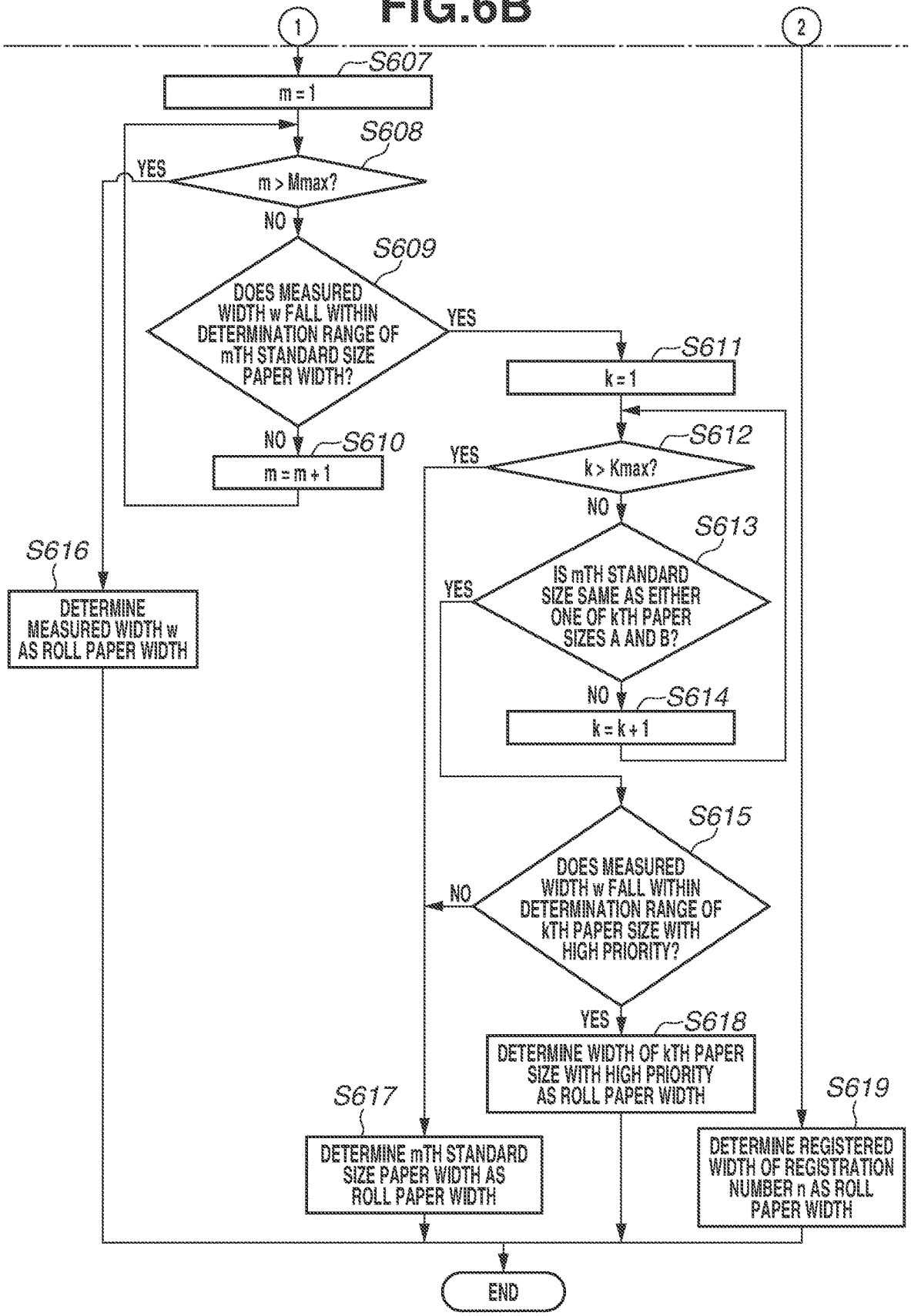

FIG. 6 is a flowchart of paper width determination processing. In the paper width determination processing, the optical sensor 155 measures the width of paper when the paper is fed, and then the paper width is determined based on the measurement result. The processing of FIG. 6 is implemented, for example, by the CPU 128 illustrated in FIG. 1 loading a program stored in the flash ROM 123 into the RAM 124 and performing processing based on the program. Alternatively, the processing may be performed by software on the host computer 190.

Figure 7:
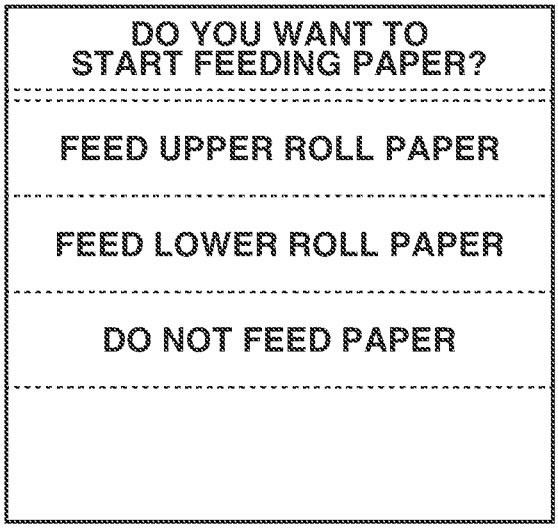
FIG. 7 is a diagram illustrating an example of a screen displayed on the input/output device according to the exemplary embodiment.

FIG. 7 is a diagram illustrating a display example of the input/output device 162 at the start of paper feeding. The paper width determination processing is started when the user gives an instruction to feed the roll paper loaded in a roll paper tube via the screen illustrated in FIG. 7. For example, if "feed upper roll paper" is selected on the screen of FIG. 7, the roll paper 204 loaded in the upper roll paper tube 201 is conveyed onto the platen 157 by the conveyance rollers 205. The following description deals with the case where "feed upper roll paper" is selected and the roll paper 204 is conveyed from the upper roll paper tube 201.

If the roll paper 204 is conveyed onto the platen 157, then in step S601, the optical sensor 155 measures the width of the roll paper 204, and the CPU 128 obtains the measured width w.

In step S602, the CPU 128 refers to the data of FIG. 5A stored in the flash ROM 123, and determines whether there is any registered paper width. If there is no registered paper width (NO in step S602), the processing proceeds to step S607. If there is any registered paper width (YES in step S602), the processing proceeds to step S603.

In step S603, the CPU 128 substitutes 1 into a registered paper counter n.

In step S604, the CPU 128 determines whether the registered paper counter n exceeds the maximum number Nmax of registered paper widths (which is 3 in the present exemplary embodiment). If the registered paper counter n exceeds Nmax (YES in step S604), the processing proceeds to step S607. If the registered paper counter n does not exceed Nmax (NO in step S604), the processing proceeds to step S605.

In step S605, the CPU 128 determines whether the measured width w obtained in step S601 falls within the determination range corresponding to registration number n in FIG. 5A. If the measured width w falls within the determination range (YES in step S605), the processing proceeds to step S619. If the measured width w does not fall within the determination range (NO in step S605), the processing proceeds to step S606.

In step S619, the CPU 128 determines the registered width of registration number n, which has been subjected to the determination in step S605, as the width of the roll paper 204. Then the paper width determination processing ends.

In step S606, the CPU 128 increases the value of the registered paper counter n by one. Then the processing proceeds to step S604.

In step S607, the CPU 128 substitutes 1 into a standard paper counter m.

In step S608, the CPU 128 determines whether the standard paper counter m exceeds the maximum number Mmax of standard size paper widths. The maximum number Mmax of standard size paper widths is the number of standard sizes of paper stored in the flash ROM 123. In the present exemplary embodiment, because 17 standard sizes are stored as illustrated in FIG. 5B, the maximum number Mmax of standard size paper widths is 17. If the standard paper counter m exceeds the maximum number Mmax of standard size paper widths (YES in step S608), the processing proceeds to step S616. If the standard paper counter m does not exceed the maximum number Mmax (NO in step S608), the processing proceeds to step S609.

In step S616, the CPU 128 determines the measured width w obtained in step S601 as the width of the roll paper 204. Then the paper width determination processing ends.

In step S609, the CPU 128 determines whether the measured width w obtained in step S601 falls within the determination range of the mth standard size paper width in FIG. 5B. The standard paper counter m corresponds to the number in in FIG. 5B. If m=3, the CPU 128 compares the measured width w with the width of paper No. 3, i.e., 12-inch roll paper. As described above, the determination range of standard size paper corresponds to a tolerance of ±1% of the width of the paper illustrated in FIG. 5B. If the measured width w falls within the determination range (YES in step S609), the processing proceeds to step S611. If the measured width w does not fall within the determination range (NO in step S609), the processing proceeds to step S610.

In step S610, the CPU 128 increases the value of the standard paper counter m by one. Then the processing proceeds to step S608.

In step S611, the CPU 128 substitutes 1 into a priority setting counter k.

In step S612, the CPU 128 determines whether the priority setting counter k exceeds the number Kmax of registered priority settings. If the priority setting counter k exceeds Kmax (YES in step S612), the processing proceeds to step S617. If the priority setting counter k does not exceed Kmax (NO in step S612), the processing proceeds to step S613.

In step S613, the CPU 128 determines whether the standard size subjected to the determination in step S609 is the same as either one of the kth paper sizes A and B in FIG. 5C. The priority setting counter k corresponds to the number in the "No." column in FIG. 5C. If the standard size is the same as either one of the kth paper sizes A and B (YES in step S613), the processing proceeds to step S615. If not (NO in step S613), the processing proceeds to step S614.

In step S614, the CPU 128 increases the value of the priority setting counter k by one. Then the processing proceeds to step S612.

In step S615, the CPU 128 determines whether the measured width w obtained in step S601 falls within the determination range of the kth paper size that is stored in the "priority setting" column of FIG. 5C. If the measured width w falls within the determination range (YES in step S615), the processing proceeds to step S618. If the measured width w does not fall within the determination range (NO in step S615), the processing proceeds to step S617.

In step S617, the CPU 128 determines the mth standard size paper width obtained in step S609 as the width of the roll paper 204. Then the paper width determination processing ends.

In step S618, the CPU 128 determines the width of either one of the kth paper sizes A and B that is stored as the priority setting in FIG. 5C, as the width of the roll paper 204. Then the paper width determination processing ends.

As described above, in the present exemplary embodiment, the width of non-standard size paper can be registered and the paper can be used like standard size paper. The paper type can thus be determined from among standard size paper and user-registered paper by a single measurement. The user therefore does not need to make operations to change the paper width setting each time a different size of paper is used, or set the width of non-standard size paper each time the paper is fed. In addition, the registration of non-standard size paper as user-registered paper can make the magnification ratio of an image constant, and the same size of images can thus be obtained even with non-standard size paper.

In the present exemplary embodiment, paper registered by the user (user-registered paper) is considered more likely to be used by the user, and a registered paper width is thus determined as the width of fed paper with priority over standard size paper widths. Alternatively, a standard size paper width may be preferentially determined as the width of fed paper.

If fed paper is neither standard size paper nor paper of registered width, the actual measured value can be set as the paper width, so that the paper width can be set without stopping the paper feed operation. Alternatively, the paper width may be set by the user. While the foregoing description has dealt with the size setting of roll paper, the present exemplary embodiment may be applied to cut sheets.

According to the foregoing exemplary embodiment, the user can reduce the time and effort to set a paper size by registering in advance the paper widths to be used and comparing the registered widths with a width measured by the optical sensor 155.

Other Embodiments

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-036035, filed Mar. 3, 2020, which is hereby incorporated by reference herein in its entirety.

What is claimed is:

1. A conveyance apparatus comprising:

a conveyance unit configured to convey paper;

a first storage unit configured to store a width of standard paper, wherein the width of the standard paper is a length in a direction crossing a conveyance direction of the paper conveyed by the conveyance unit;

a second storage unit configured to store a user-registered paper width which is different from the width of the standard paper, wherein the user-registered paper width is input by a user;

a measurement unit configured to measure a width of the paper; and a determination unit configured to determine, based on the measured width and the paper widths stored in the first storage unit and the second storage unit, a width to serve as the measured width.

2. The conveyance apparatus according to claim 1, wherein, if the measured width falls within a predetermined range of the stored standard paper width or the stored user-registered paper width, the determination unit determines the paper width stored in the first storage unit or the paper width stored in the second storage unit as the width to serve as the width of the paper measured by the measurement unit.

3. The conveyance apparatus according to claim 2, wherein, if the measured width is determined to be neither of the stored standard paper width and the stored user-registered paper width, the determination unit determines the measured width as the width to serve as the width of the paper measured by the measurement unit.

4. The conveyance apparatus according to claim 2, wherein the predetermined range can be set differently depending on paper widths.

5. The conveyance apparatus according to claim 2, wherein the first storage unit is configured to store a priority for the determination with respect to paper widths of which predetermined ranges overlap among a plurality of the paper widths stored in the first storage unit, and wherein, if the measured width is determined to fall within the overlap between the predetermined ranges of the paper widths stored in the first storage unit, the determination unit determines the width to serve as the measured width based on the stored priority.

6. The conveyance apparatus according to claim 1, wherein the second storage unit is configured to store a plurality of the user-registered paper widths.

7. The conveyance apparatus according to claim 1, wherein the determination unit is configured to give priority to determining the user-registered paper width as the width to serve as the measured width over determining the width of the standard paper as the width to serve as the measured width.

8. The conveyance apparatus according to claim 1, further comprising a recording unit configured to record an image on the paper conveyed to a recording position by the conveyance unit, wherein the determination unit is configured to determine the width of the paper as a width to be used for control in the recording of the image by the recording unit on the paper measured by the measurement unit.

9. The conveyance apparatus according to claim 8, further comprising a generation unit configured to generate image data for the recording of the image by the recording unit based on the determined width to be used for the control in the recording of the image.

10. The conveyance apparatus according to claim 1, wherein the user-registered paper width stored in the second storage unit is deletable.

11. The conveyance apparatus according to claim 1, further comprising an acceptance unit configured to accept an input for registering the user-registered paper width in the second storage unit.

12. The conveyance apparatus according to claim 11, wherein the acceptance unit is configured to accept the input for registering the user-registered paper width while the conveyance unit is not conveying the paper.

13. The conveyance apparatus according to claim 11, further comprising a recording unit configured to record an image on the paper conveyed to a recording position by the conveyance unit, wherein the acceptance unit is configured to accept the input for registering the user-registered paper width while the conveyance unit is not conveying the paper and while the recording unit is not recording the image on the paper.

14. A method for a conveyance apparatus, the method comprising:

conveying paper;

storing, as a first storage, a width of standard paper, wherein the width of the standard paper is a length in a direction crossing a conveyance direction of the conveyed paper;

storing, as a second storage, a user-registered paper width which is different from the width of the standard paper, wherein the user-registered paper width is input by a user;

measuring a width of the paper; and determining, based on the measured width and the paper widths stored in the first storage and the second storage, a width to serve as the measured width.

15. The method according to claim 14, further comprising using the determined width to control a recording unit to record an image on the paper.

16. A non-transitory computer-readable storage medium storing a program to cause a computer to perform a method for a conveyance apparatus, the method comprising:

conveying paper;

storing, as a first storage, a width of standard paper, wherein the width of the standard paper is a length in a direction crossing a conveyance direction of the conveyed paper;

storing, as a second storage, a user-registered paper width which is different from the width of the standard paper, wherein the user-registered paper width is input by a user;

measuring a width of the paper; and determining, based on the measured width and the paper widths stored in the first storage and the second storage, a width to serve as the measured width.

* * * * *